United States Patent [19]

Peyre

[11] Patent Number: 4,708,360

[45] Date of Patent: Nov. 24, 1987

[54] SKI BRAKE

[75] Inventor: Henri Peyre, Nevers, France

[73] Assignee: Ste LOOK, Nevers, France

[21] Appl. No.: 885,704

[22] Filed: Jul. 15, 1986

[30] Foreign Application Priority Data

Jul. 26, 1985 [FR] France ..... 85 11439
Mar. 25, 1986 [FR] France ..... 86 04224

[51] Int. Cl.[4] ..... A63C 7/10
[52] U.S. Cl. ..... 280/605
[58] Field of Search ..... 280/605; 188/5, 7

[56] References Cited

U.S. PATENT DOCUMENTS 4,350,364 9/1982 Salomon ..... 280/605
4,386,788 6/1983 Krob ..... 280/605
4,488,734 12/1984 Beyl et al. ..... 280/605
4,602,803 7/1986 Guitel ..... 280/605

FOREIGN PATENT DOCUMENTS 2501051 9/1982 France ..... 280/605

*Primary Examiner*—David M. Mitchell
*Attorney, Agent, or Firm*—Young & Thompson

[57] ABSTRACT

The operating pedal of a ski brake is directly pivoted about a cross-pin carried by the ski and mounted on the pedal at the end remote from the bearings which receive the elbowed extensions formed on the control ends of the braking arms. The braking ends of the arms are joined to the control ends by means of central portions which are capable of sliding on the top face of the ski during pivotal movements of the operating pedal about its cross-pin.

8 Claims, 5 Drawing Figures

SKI BRAKE

BACKGROUND OF THE INVENTION

1. Field of the Invention

The present invention relates to a retractable ski brake mounted on the top face of the ski for pivotal motion about a transverse axis.

2. Description of the Prior Art

Many designs of ski brakes are already known. As a general rule, a ski brake is made up of two pivotal arms formed of rigid wire members suitably arranged so as to extend respectively on each side of the edge faces of the ski in the opened-out position of the ski brake, the end portions of the braking arms which extend beyond the apparent contour of the ski being advantageously provided with braking shoes for the purpose of achieving enhanced braking efficiency, in particular when the ski escapes from the user's ski boot and begins to slide down a ski slope. The opposite ends of the braking arms are associated with an operating pedal which is applied against the top face of the ski when the skier's boot is in position on the ski.

In a known design disclosed in French Pat. No. 80.12836 filed in the name of the Applicant company, a particular feature lies in the fact that the braking-arm end portions which cooperate with the pedal are so shaped that, when the operating pedal is applied flat against the ski, the opposite end portions which carry the braking shoes are inwardly withdrawn above the ski without projecting beyond the edge faces of this latter and freely placed in position beneath the sole of the ski boot. To this end, and in accordance with a preferred embodiment of the invention as described in the prior patent cited in the foregoing, the ends of the braking arms which cooperate with the operating pedal (designated as control ends in contradistinction to the braking ends which carry the braking shoes) are provided with elbowed extensions pivotally mounted in bearings provided on or within the operating pedal. The shape of these extensions as well as the shape of the pivotal arms are such that, in the inactive position of the ski brake, said extensions form a V, the point of which is directed either downwards or towards the tip of the ski. At the time of operation of the ski brake, the active or braking ends are thus outwardly displaced on each side of the ski whereas, in the withdrawn position, said braking ends are close together and set back with respect to the edge faces of the ski. Moreover, a resilient restoring member continuously tends to produce a pivotal displacement of the operating pedal with respect to the braking arms to an angular position such that the braking ends of said arms are spaced apart to a sufficient extent to move clear of the edge faces on each side of the ski.

Control of a ski brake of this type takes place in two stages when the skier engages his or her boot in the corresponding ski binding. In a first stage, the operating pedal of the braking system is pivotally displaced as a single unit from a position above the ski to a position in which it comes into contact with the top face of this latter whilst the braking arms undergo a pivotal displacement in different bearings carried by a base plate which is fixed on the top face of the ski. The active or braking ends are thus moved to a position located substantially in the top plane of the ski but remain in outwardly spaced relation, thereby ensuring that they are not liable to come into contact with or jam against the edge faces of the ski while their movement of pivotal displacement is taking place. In a second stage, the operating pedal is in turn applied flat against the top face of the ski, this movement being necessarily accompanied by a movement of relative inward withdrawal of the braking ends above the ski by reason of the inclined orientation of the control-end extensions in bearings fixed on or carried by the operating pedal. This in turn results in relative displacement of the cranked portions of the pivotal arms which pass through the bearings fixed on the base plate. The restoring spring which acts in tension and is mounted between a fixed point of the base plate at the front end of this latter and the operating pedal makes it possible to exert on this latter a continuous effort which tends to lift said pedal with respect to the top face of the ski. It is thus ensured that, in the event of a ski-boot release, the operating pedal returns immediately to a position in which the braking ends are first moved away from each other, then downwards in order to stop the ski by means of the braking shoes with which said ends are fitted.

A system of this type offers many advantages, especially in regard to the fact that it provides a rugged and reliable assembly which is particularly appreciated by users and permits mass production by virtue of its simple design.

SUMMARY OF THE INVENTION

The present invention relates to a ski brake which is similar to the braking system recalled in the foregoing insofar as it has two pivotal braking arms provided with braking ends adapted to carry braking shoes and capable of extending downwards with respect to the top plane of the ski. Said pivotal arms are also provided with control ends located opposite to the braking ends and having elbowed extensions which form a V whose point is either directed downwards or else is directed forwards when the ski brake is applied in a flat position against the top face of the ski. Said elbowed extensions are rotatably mounted in bearings provided on an operating pedal which is subjected to the action of a mechanism for elastically restoring said pedal to the raised position. In consequence, the application of said operating pedal against the top face of the ski in opposition to said elastic restoring mechanism has the effect of subjecting the braking ends to a movement of upward pivotal displacement at the same time as a movement of relative inward withdrawal. By virtue of these arrangements in which each braking shoe comes into light frictional contact with the top portion or arris of the respective edge face of the ski, the braking arms are elastically deformed so as to re-close on the top face of the ski. When the operating pedal is freed at the time of boot disengagement, the pedal lifts and has the effect in an initial stage of producing a movement of relative outward displacement of the braking arms and then of subjecting these latter to a downward pivotal displacement when the braking shoes provided at the ends of the arms move away from the top ski surface. The invention also permits an appreciable simplification of the ski-brake structure developed in the state of the art recalled earlier, in particular by dispensing with the need for the complementary bearings which were provided on the base plate of the ski and in which the braking arms pivoted during movements of the operating pedal.

The invention is also directed to a ski brake in which the movement of the operating pedal which causes upward retraction and relative inward withdrawal of the braking arms takes place in the same direction as the movement of the ski boot at the time of engagement in its ski binding and not in a direction opposite to the movement of boot engagement as was the case with the known device discussed earlier. This facilitates the operation of the ski brake even further and is conducive to enhanced efficiency of the system.

With this objective, the distinctive feature of the ski brake under consideration lies in the fact that the operating pedal is directly pivoted about a cross-pin carried by the ski and mounted on said pedal at the end remote from the bearings which receive the elbowed extensions of the control ends of the arms, the braking ends being joined to the control ends by means of central portions which are capable of sliding on a support plate fixed on the top face of the ski during movements of the operating pedal about its cross-pin.

According to a particular feature of the invention, each braking arm has a central portion which is bent-back substantially at right angles, said central portion being constituted by the control end and braking end of a wire member.

In a first embodiment of the invention, the mechanism for elastically restoring the operating pedal is made up of two separate springs each stretched between the cross-pin on which the pedal is pivotally mounted and the central portion of each braking arm in order to draw these latter towards the cross-pin and initiate the movement of upward displacement of the pedal.

In another embodiment, the elastic restoring mechanism comprises a single spring, the two ends of said spring being coiled around a supporting shaft which is parallel to the pivot-pin of the operating pedal and provided with extensions applied against the bottom face of the pedal, the two ends of the spring being joined to each other by means of a central loop. Said loop is applied on the control ends of the braking arms and exerts on these latter a thrust which causes upward displacement of the operating pedal.

In accordance with another distinctive feature of the invention, the central portion of the braking arms is capable of sliding on one or two inclined planes which permit compensation for relative height displacement of the braking arms with respect to the operating pedal. Said braking arms may thus be located directly above the top face of the ski when the braking system is in the inactive position.

In certain instances, a difficulty may be encountered when mounting the various ski-brake components, especially when the constructional design of the elastic restoring mechanism involves the use of a single spring. Thus in actual practice, the pivot-pin of the operating pedal is mounted on a retaining support plate which is in turn intended to be screwed on the ski. The ski brake is accordingly manufactured and marketed in the mounted state, in particular with the pedal pivotally mounted on the support plate which then requires only to be screwed in the correct position on the ski.

In point of fact, when no provision is made for special arrangements and in particular for suitable tool equipment, mounting of ski-brake components is in practice a very difficult operation. By reason of the relative position locations of the different ski-brake components, it is first necessary to mount the spring-supporting shaft beneath the operating pedal, then to engage within the central loop of the spring the two braking arms which have previously been bent and preformed in order to insert their elbowed extensions in the bearings provided on said operating pedal. In the following stage, it is then necessary to place the support plate in position and in particular to mount the articulation cross-pin or pivot-pin between the operating pedal and the support plate. However, by reason of the force which is applied by the central loop of the spring on the control ends of the braking arms and which tends to lift these latter, positioning of the support plate and engagement of the pivot-pin represent intricate operations which are difficult to perform, particularly under satisfactory conditions of speed and safety.

In order to overcome this disadvantage, means are advantageously provided for temporarily retaining the spring of the elastic restoring mechanism in the stretched position at the time of assembly of parts, then releasing the spring in its position of normal utilization, in particular after positioning of the cross-pin on which the operating pedal is pivoted to the support plate.

To this end, and in accordance with another distinctive feature of the invention, the bottom pedal face or underface which is directed towards the top surface of the ski and against which are fixed the bearings for receiving the elbowed extensions of the braking arms is provided with a metal lug which is initially bent back towards the underface of the pedal for temporarily retaining the central loop of the spring of the elastic restoring mechanism. Said metal lug is intended to be subsequently opened-out for the purpose of releasing the spring after positioning on the pivot-pin of the operating pedal a support plate for fixing the braking system on the ski.

BRIEF DESCRIPTION OF THE DRAWINGS

These and other features of the invention will be more apparent to those skilled in the art upon consideration of the following description and accompanying drawings, wherein.

DESCRIPTION OF THE PREFERRED EMBODIMENTS

Figures 1, 2, 3:
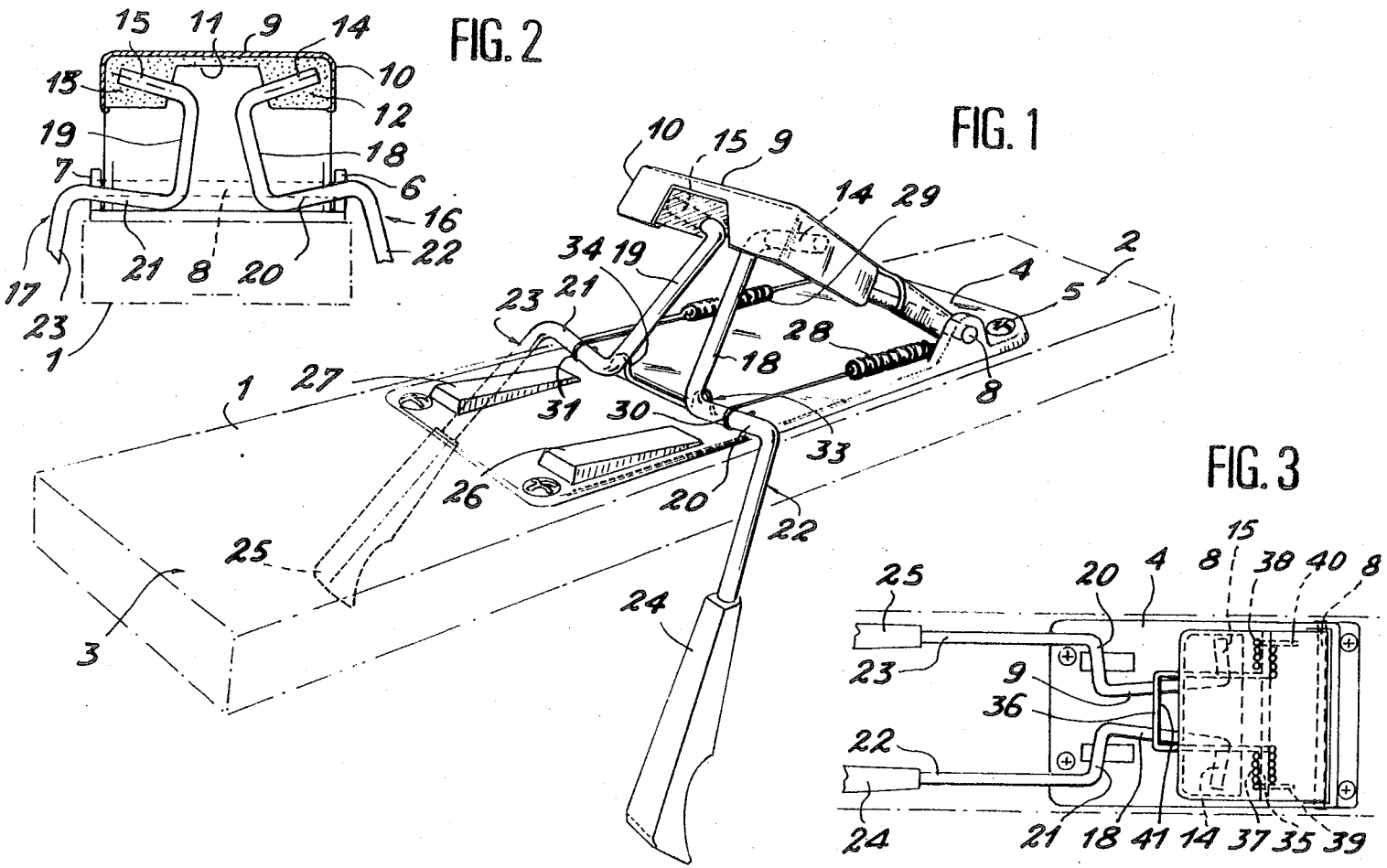
FIG. 1 is a perspective view of a retractable ski-brake constructed in accordance with a first embodiment of the invention.
FIG. 2 is a front view of the operating pedal shown in FIG. 1, this view being taken partly in crosssection along a plane which passes through the control ends of the pivotal braking arms.
FIG. 3 is a top view of a ski brake in accordance with another embodiment of the invention.

In the example of construction shown in FIGS. 1 and 2, the reference numeral 1 designates a portion of ski limited to that region of this latter in which the ski brake in accordance with the invention is intended to be mounted, especially beneath the location of the ski boot which actuates the braking system at the time of engagement of said boot in a ski binding (not shown in the drawings). The reference numerals 2 and 3 designate the ends of the portion 1 which are directed respectively towards the front end and towards the rear end of the ski.

The ski brake under consideration includes a spring-retaining support plate 4 which is fixed on the portion 1 of the ski by means of screws 5. Said retaining support plate is provided with two side lugs 6 and 7 respectively, an articulation cross-pin or pivot-pin 8 being mounted between said lugs and thus disposed in the vicinity of the top plane of the ski above the support plate 4.

On the cross-pin 8 is pivotally mounted an operating pedal 9 for actuating the ski brake. Said pedal is constituted by a cover-plate 10 having downwardly flanged edges, the pedal face which is directed towards the rear end 3 of the ski being provided with an opening 11 through which the braking arms are permitted to pass in the manner explained hereinafter.

Provision is also made for two bearings 12 and 13 respectively which are mounted beneath the cover-plate 10. The detail design of these bearings is not directly relevant to the present invention and various alternative forms of construction have already been contemplated, for example in French Pat. No. 80.12836 in the name of the Applicant company. In consequence, only a schematic representation of these bearings 12 and 13 is given in the accompanying figures. It is nevertheless worthy of note that, in accordance with an arrangement contemplated in the above-mentioned prior patent, the bearings have an orientation such that their respective directions form a very open V, the point of which is directed either towards the front end of the ski or downwards when the operating pedal 9 is in the flat position. Within each bearing 12 and 13 are engaged two portions forming extensions 14 and 15 respectively of the intermediate or so-called control ends 18 and 19 of the two braking arms 16 and 17 which form part of the ski brake considered and extend on each side of the ski. In this example of construction, said braking arms, control ends and extensions are formed of suitably shaped wire. The control ends 18 and 19 pass through the opening 11 formed in the flanged edge of the cover-plate 10 and are joined at the end remote from the extensions 14 and 15 to two central portions 20 and 21 which are elbowed at right angles. After another right-angled elbow, said central portions are in turn extended by two other end portions or so-called braking ends which are designated by the references 22 and 23. Said braking ends pass over the edge faces of the ski 1 in the position illustrated in particular in FIG. 1. Said braking ends 22 and 23 are fitted with terminal braking shoes 24 and 25 of a type known per se.

The ski brake further comprises one or two inclined planes or ramps 26 and 27 which are mounted on the rear portion of the support plate 4 and intended to cooperate respectively with the central portions 20 and 21 of the braking arms 16 and 17. Said ramps are so arranged that their highest ends are directed towards the rear portion 3 of the ski.

In addition, in the example of construction considered in FIGS. 1 and 2, the aforementioned central portions 20 and 21 are coupled to the articulation cross-pin 8 of the operating pedal 9 by means of an elastic restoring mechanism formed by two springs designated respectively by the references 28 and 29. Said springs are engaged respectively on each central portion aforesaid and extend up to the pivot-pin 8 on each side of the operating pedal 9. By means of hooks 30 and 31 formed at the ends of the springs 28 and 29 and engaged over said central portions 20 and 21, said springs thus exert on the braking arms 16 and 17 a tractive force which tends to restore the ski brake to the so-called active position shown in FIG. 1 in which the braking ends 22 and 23 project from the lateral edges of the ski and extend in the downward direction.

As an advantageous feature, the range of travel of the pivotal braking arms 16 and 17 towards the front portion 2 of the ski under the action of the springs 28 and 29 is limited by means of two stops provided on the corresponding edge of the support plate 4 and designated respectively by the references 33 and 34. The control ends 18 and 19 are applied against said stops in this end-of-travel position.

The invention thus leads to the practical realization of a retractable ski brake of very simple design in which, in particular, the pivotal displacement of the operating pedal which controls the braking arms is produced by a movement which takes place naturally as the user's ski boot is placed in position on the corresponding portion of the ski.

In fact, when the skier's boot is engaged with the ski, the boot exerts on the operating pedal 9 an effort which applies this latter against the support plate 4 while the central portions 20 and 21 are displaced in sliding motion on said support plate at the same time, thus producing a movement of rotation of the braking arms 16 and 17 within the bearings 13 and 14. As a result of their orientation, the bearings cause the arms to perform a movement of inward withdrawal with respect to the axis of the ski, the design elasticity of said arms being such as to enable the braking shoes 24 and 25 to pass over the top portions or arrises of the edge faces of the ski if there is any interference with these latter and thus to return to their inwardly withdrawn position on the top face of the ski.

In the event of either deliberate or accidental boot disengagement, in particular at the time of a falling movement of the skier which produces an effect such that the ski boot is released from its binding, the ends of the braking shoes 24 and 25 bear on the ski and the operating pedal 9 is free to lift, thus causing rotation of the elbowed extensions 14 and 15 of the braking arms within the bearings 12 and 13 and relative outward displacement of the end portions of said arms as a result of the orientation of said bearings on the operating pedal. When the braking arms move away from the top face of the ski, they continue to rotate until they come into contact with the stops 33 and 34 of the support plate 4.

In another example of construction illustrated in FIG. 3, the essential elements of the ski-brake structure in accordance with the invention are again shown. In this embodiment, however, consideration is given to an alternative design of the elastic restoring mechanism for continuously exerting the necessary lifting force on the operating pedal 9. To this end, the pedal 9 is provided with a complementary cross-pin 35 which extends in a direction parallel to the pivot-pin 8 at a short distance above this latter. Said cross-pin 35 is associated with a single spring 36 which is suitably preformed and is provided in particular with two end portions 37 and 38 respectively which are coiled around the cross-pin 35 and have extensions 39 and 40, said extensions being applied against the internal surface of the cover-plate 10. In the central portion of the spring 36, the two arms of said spring are joined to each other by means of a transverse portion designated as a central loop 41 which passes over the top of the control ends 18 and 19 of the braking arms and exerts on these latter a restoring force equivalent to the force produced in the first exemplified embodiment by the two springs associated with each central portion.

In either of the two examples of construction described in the foregoing, the bearings 12 and 13 (in which the extensions 14 and 15 are pivotally mounted and form between them a wide-angle V whose point is directed downwards or towards the front end of the ski when the operating pedal is in a flat position on the ski) constitute the sole points of connection of the pedal 9 with the braking arms 16 and 17. Said braking arms are thus free to slide on the support plate 4 during a movement of the pedal, in particular without entailing the need for complementary bearings on the top face of the ski as was the case in known designs of the prior art. Such complementary bearings were provided in particular for maintaining the braking arms on the one hand during their successive movements of pivotal displacement and on the other hand during their movements of relative inward withdrawal.

The result thereby achieved is greater simplicity of manufacture and a substantial overall reduction in capital cost. Moreover, the very simple structure of the ski brake permits maintenance as well as any possible repair work which may be required, for example, in order to replace one of the arms without having to carry out complete disassembly of the braking system.

In the alternative embodiment which is more particularly illustrated in FIG. 3, the use of a single spring for the elastic restoring mechanism may possibly lead to difficulties at the time of production assembly of the different ski-brake components. In order to overcome this drawback while making it possible in particular to position the braking arms 16 and 17 within the bearings 12 and 13 carried by the bottom face of the operating pedal 9 and at the same time permitting pivotal attachment of said pedal to the support plate 4 in spite of the thrust continuously exerted by the spring 36 on said arms, provision is advantageously made beneath the operating pedal 9 (as shown in FIG. 4) for a metal lug 44 which, in an initial stage of assembly, is bent-back towards the pedal surface in order to retain the central loop 41 of the spring 36 in a stationary position by maintaining this latter applied against the surface of the operating pedal.

In this position, in which the spring 36 is therefore applied against the pedal 9 and prevented from releasing its energy, it becomes possible to engage the control ends 18 and 19 of the two braking arms 16 and 17 within the central loop 41 and to insert the elbowed extensions 14 and 15 of said control ends in the bearings 12 and 13 which have previously been maintained in a stationary position beneath the operating pedal. In the next stage, the operating pedal which carries the braking arms 16 and 17 can be pivotally attached to the support plate 4 without difficulty by engaging the pivot-pin 8 of these two elements in its intended position.

Once the different parts have thus been placed in position, it is then only necessary to exert a reerecting force on the end of the lug 44 in order to restore this latter to a position at right angles to the pedal 9, this operation being performed by means of a suitable tool designated by the reference A. As shown in chain-dotted lines in FIG. 5, this operation serves to release the central loop 41 of the spring 36 which is thus unstressed and permitted to move to its effective utilization position in which it is applied against the control portions 18 and 19 of the braking arms 16 and 17. This condition of the ski brake is illustrated in full lines in FIG. 5. A point worthy of note is that, in this position, the central portions 20 and 21 of the braking arms engage within recesses 43 formed in lateral flanks 42 which are advantageously provided as a design feature of the support plate 4.

Figure 4:
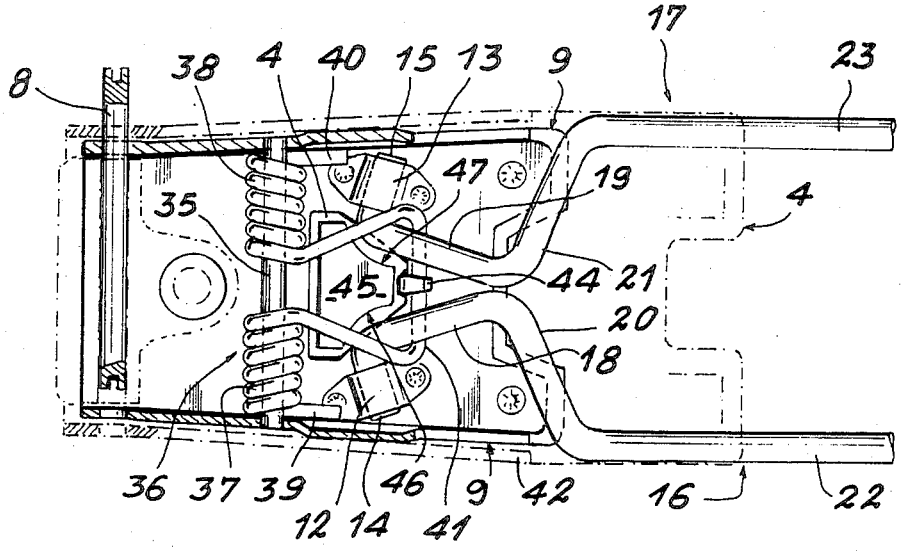
FIG. 4 is another representation of the ski brake in accordance with the embodiment of FIG. 3, looking on the underside of the operating pedal.
Figure 5:
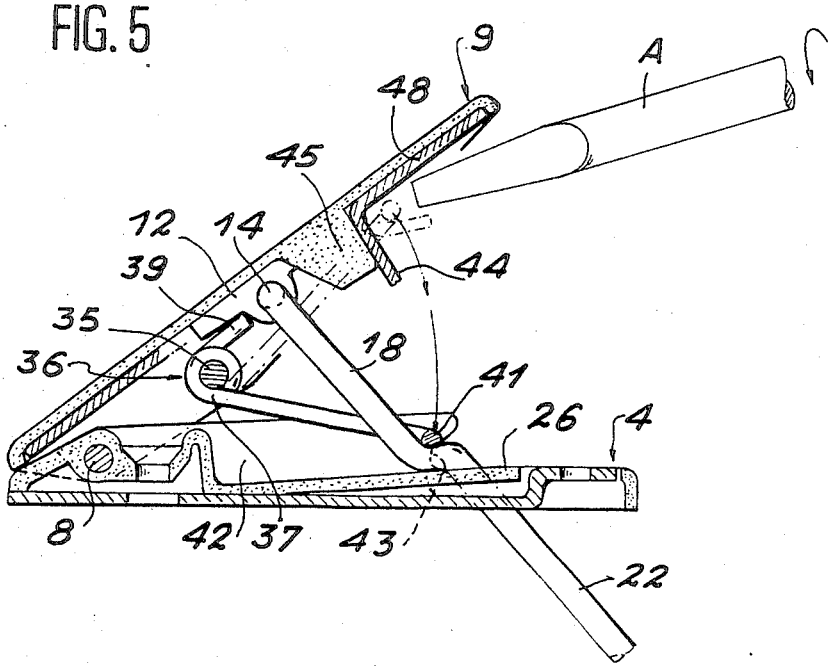
FIG. 5 is a side view of the ski brake in accordance with FIG. 4.

As shown in FIGS. 4 and 5, the extent to which the lug 44 is opened-out by the tool A is advantageously limited by means of a raised abutment heel 45 formed beneath the operating pedal 9. In addition, each lateral edge of said abutment heel 45 has curved portions designated respectively by the references 46 and 47, the intended function of said curved portions being to permit angular displacement of the control ends 18 and 19 of the braking arms during movements of the ski brake and especially to permit pivotal motion of the elbowed extensions 14 and 15 within the bearings 12 and 13.

In accordance with another preferred feature, the lug 44 which has the function of retaining and then releasing the spring 36 in the manner indicated in the foregoing is cut-out and bent-back from a small metal plate 48, said small plate being stationarily fixed beneath the operating pedal 9 by any suitable means.

As will be readily apparent, the invention is not limited solely to the example of construction specifically described in the foregoing with reference to the accompanying drawings but extends on the contrary to all alternative forms. It is self-evident in particular that, in the case of the springs employed for lifting the operating pedal or the plate which supports the pivot-pin of said pedal, any number of alternative designs and shapes may be contemplated without thereby departing either from the scope or the spirit of the invention.

What is claimed is:

1. In a ski brake comprising an operating pedal pivotably mounted on a pin for pivotal movement about said pin between raised and lowered positions; means for mounting said pin on the upper surface of a ski; a pair of braking arms each having a first end pivotally mounted on said operating pedal for pivotal movement about an axis, a second end adapted to receive a braking element, and an intermediate, inwardly bent portion having a horizontally disposed region adapted to slide along said mounting means responsive to conjoint pivotal movement of said operating pedal about said pin and said first ends about their respective axes; each said second end extending obliquely relative to the said pivotal axis of its corresponding said first end, whereby said conjoint pivotal movement from said lowered position to said raised position of said operating pedal displaces said second ends of said braking arm pair downwardly and outwardly relative to said upper surface of said ski; and elastic means urging said operating pedal toward said raised position; the improvement in which said elastic means comprises a single spring having two ends coiled around a supporting shaft extending parallel to said pin and having extensions bearing against a lower face of said operating pedal, said two ends being interconnected by a central loop bearing against said intermediate portions of said braking arm pair to exert on said braking arm pair a thrust urging said operating pedal toward its said raised position and maintaining said horizontally disposed regions in sliding contact with said mounting means.

2. Ski brake according to claim 1, wherein said intermediate, inwardly bent portion of each said braking arm pair comprises a first section extending transversely to its corresponding said second end, a second section substantially parallel to its corresponding said second end, said first end of each said braking arm pair being bent outwardly from its corresponding said second section, and said first section comprising said horizontally disposed region adapted to slide along said mounting means.

3. Ski brake according to claim 1, wherein said mounting means comprises at least one inclined ramp portion disposed to coact with said horizontally disposed regions of said braking arm pair during said sliding movement of said horizontally disposed regions, thereby to displace said braking arm pair upwardly relative to said upper surface of said ski.

4. Ski brake according to claim 1, wherein said central loop of said spring extends a predetermined distance from said supporting shaft, and said lower face of said operating pedal comprises a deformable tab spaced said predetermined distance from said supporting shaft, said deformable tab being sufficiently rigid to receive and hold said central loop of said spring against the action of said spring.

5. Ski brake according to claim 4, wherein said deformable tab is mounted on said lower face of said operating pedal through the intermediary of a raised abutment heel, said raised abutment heel having curved portions permitting angular displacement of said intermediate portions of said braking arm pair.

6. Ski brake according to claim 2, wherein said operating pedal is in the form of a cover plate having downwardly depending side walls comprising a first side wall disposed opposite and parallel to said pin, said first side wall comprising a recess permitting passage of said second sections of said intermediate portions of said braking arm pair.

7. Ski brake according to claim 1, wherein said mounting means comprise stop means limiting the extent of sliding contact of said horizontally disposed regions.

8. Ski brake according to claim 1, wherein the said axes of said first ends of said braking arm pair together form an oblique angle.

* * * * *